US006827628B2

(12) United States Patent
Kaye et al.

(10) Patent No.: US 6,827,628 B2
(45) Date of Patent: Dec. 7, 2004

(54) NON-SLIP SHOULDER STRAP FOR A BRASSIERE

(75) Inventors: Joanne J. Kaye, New York, NY (US); Helga Dahl-Selmer, Staten Island, NY (US); Jeanne Martini, Brooklyn, NY (US)

(73) Assignee: Sara Lee Corporation, Winston-Salem, NC (US)

( * ) Notice: Subject to any disclaimer, the term of this patent is extended or adjusted under 35 U.S.C. 154(b) by 210 days.

(21) Appl. No.: 10/112,594

(22) Filed: Mar. 29, 2002

(65) Prior Publication Data

US 2003/0186620 A1 Oct. 2, 2003

(51) Int. Cl.[7] ..... A41F 15/02; A41D 27/26

(52) U.S. Cl. ..... 450/86; 2/268

(58) Field of Search ..... 450/86, 81, 101, 450/106, 112, 113; 2/267, 268, 220, 221, 237, 338, 308, 337; 224/642, 643

(56) References Cited

U.S. PATENT DOCUMENTS

| | | | | |
|---|---|---|---|---|
| 2,032,935 A | | 3/1936 | Hurt | |
| 2,505,272 A | | 4/1950 | Blalock et al. | |
| 2,514,108 A | * | 7/1950 | Vogt | 2/259 |
| 2,643,380 A | | 6/1953 | Blair | |
| 2,753,569 A | | 7/1956 | Schmalz | |
| 2,849,723 A | | 9/1958 | Marino | |
| 3,009,723 A | | 11/1961 | Owen et al. | |
| 3,153,245 A | | 10/1964 | Silverman | 2/338 |
| 3,153,246 A | | 10/1964 | Silverman | |
| 3,186,412 A | | 6/1965 | Kurland | |
| 3,229,694 A | | 1/1966 | Koropp | |
| 3,253,599 A | | 5/1966 | Larsen | |
| 3,306,299 A | | 2/1967 | Paramore | |
| 3,465,757 A | | 9/1969 | Barg | |
| 3,478,748 A | | 11/1969 | Larsen | |
| 3,638,658 A | | 2/1972 | Becker et al. | |
| 3,854,978 A | | 12/1974 | Campbell, Sr. et al. | |
| 3,930,090 A | * | 12/1975 | Campbell, Sr. et al. | 2/237 |
| 3,978,259 A | * | 8/1976 | Hilton | 2/221 |
| 4,701,964 A | | 10/1987 | Bell et al. | |
| 4,795,399 A | | 1/1989 | Davis | |
| 4,795,400 A | | 1/1989 | Greenberg | |
| 4,815,149 A | | 3/1989 | Erhardt et al. | |
| 5,292,044 A | | 3/1994 | Reimers | |
| 5,419,475 A | | 5/1995 | Naritomi | |
| 5,474,487 A | | 12/1995 | Roush et al. | |
| 5,539,931 A | | 7/1996 | Fizer et al. | |
| 5,558,556 A | | 9/1996 | Froehlich | |
| 5,803,792 A | | 9/1998 | Roush et al. | |
| 5,914,082 A | | 6/1999 | Harrison | |
| 5,928,593 A | | 7/1999 | Harrison | |
| 5,939,004 A | | 8/1999 | Harrison | |
| 6,135,852 A | | 10/2000 | Young | |
| 6,139,787 A | | 10/2000 | Harrison | |
| 6,179,178 B1 | | 1/2001 | Stegmeyer | |
| 6,193,914 B1 | | 2/2001 | Harrison | |
| 6,220,492 B1 | | 4/2001 | Huang | |
| 6,241,930 B1 | | 6/2001 | Harrison | |
| 6,332,825 B1 | * | 12/2001 | Henricksen | 450/81 |
| 6,401,786 B1 | | 6/2002 | Tedeschi et al. | |
| 6,446,268 B1 | | 9/2002 | Lazarian | |
| 6,520,926 B2 | | 2/2003 | Hall | |
| 2002/0023709 A1 | | 2/2002 | Tedeschi et al. | |

OTHER PUBLICATIONS

Dr. Leonard's, 1998, pp. 18, 32; Bras.*
Road Runner Sports, Feb./Mar. '97, p. 17, items E,H.*
Title Nine Sports, Summer 2001, p. 3, item C; p. 5, item C, D; p. 12, A.*

* cited by examiner

*Primary Examiner*—Gloria M. Hale
(74) *Attorney, Agent, or Firm*—Ohlandt, Greeley, Ruggiero & Perle

(57) ABSTRACT

There is provided a brassiere strap made of a rigid fabric. The strap has a first surface with two or more rows of silicone gel. Preferably, the rows are in a straight axial line. The first surface preferably has an indicia thereon. The first surface positioned for contacting the shoulder of the wearer to prevent the brassiere strap from sliding off the shoulder of the wearer.

14 Claims, 1 Drawing Sheet

NON-SLIP SHOULDER STRAP FOR A BRASSIERE

BACKGROUND OF THE INVENTION

1. Field of the Invention

The present invention relates generally to a non-slip strap. More particularly, the present invention relates to a shoulder strap that prevents or minimizes slip or slide off the shoulder of the wearer, while at the same time having an identifier, such as, for example, the name of the shoulder strap maker.

2. Description of the Prior Art

A well known problem associated with shoulder straps, particularly brassiere shoulder straps, is their tendency to slip or slide off the shoulder of the wearer. This problem is caused by the smooth, satiny material often used to make brassiere shoulder straps. Attempts have been made to solve this problem. Such attempts include increasing the width of the brassiere shoulder straps in order to more evenly distribute the weight of the brassiere shoulder strap over the surface area of the shoulder of the wearer. Other attempts have included devices made of non-slip material that attach to the brassiere shoulder strap. However, these devices may dig into the shoulder of the wearer causing discomfort, and may cause damage to the brassiere shoulder straps. Also, these devices may cause curling of the shoulder strap.

Thus, there is a need for a brassiere shoulder strap that has desired non-slip properties, is comfortable for the wearer, and does not denigrate the shoulder strap, such as minimize undesired curling of the shoulder strap. There is also a need for such a brassiere shoulder strap that provides for an identifier to remain clearly present in the shoulder strap.

SUMMARY OF THE INVENTION

It is an object of the present invention to provide a shoulder strap, especially for a brassiere, which does not slip off, or minimizes slip off, from the shoulder of a wearer.

It is another object of the present invention is to provide such a shoulder strap that is made of a rigid material and has a non-slip surface.

It is still another object of the present invention is to provide such a shoulder strap that has text or a design printed on the non-slip surface.

It is a further object of the present invention is to provide such a brassiere shoulder strap that has one and, preferably, all of the following attributes: alleviates discomfort and irritation of the shoulder area of the wearer, has a non-bulky, aesthetic appearance, and has a long wear life.

It is a still further object of the present invention to provide such a brassiere shoulder strap that is pre-shrunk prior to the application of the non-slip surface to avoid curling of the shoulder strap.

These and other objects and advantages of the present invention are achieved by a brassiere shoulder strap having a piece of rigid fabric upon which rows of silicone gel are applied to one side of the rigid fabric, preferably in a straight vertical line. The silicone gel is preferably extruded onto the fabric in the form of a fine bead or line. The silicone gel line is applied to the side of the strap that makes contact with the shoulder of the wearer and prevents the brassiere shoulder strap from slipping or sliding off the shoulder of the wearer.

In a preferred embodiment, text or a design is printed on the one side of the fabric having the rows of silicone beads that form a continuous line. The clarity of the text or design is not effected by the silicone.

In preferred brassiere shoulder straps of the present invention, the width of the shoulder strap, which is perpendicular to the axial direction of the shoulder strap, is from about ⅝ inches to about ¾ inches. Preferably, two rows of silicone are used on the ⅝ inch wide strap embodiment, while three rows of silicone are used on the ¾ inch wide strap.

In preferred embodiments of the present invention, the text or design is applied to a surface of the shoulder strap prior to the application of the rows of silicone to the same surface of the shoulder strap. In other preferred embodiments of the present invention, including embodiments with and without a text or design, the shoulder strap is pre-shrunk prior to the application of the rows of silicone.

DETAILED DESCRIPTION OF THE INVENTION

Figure 1:
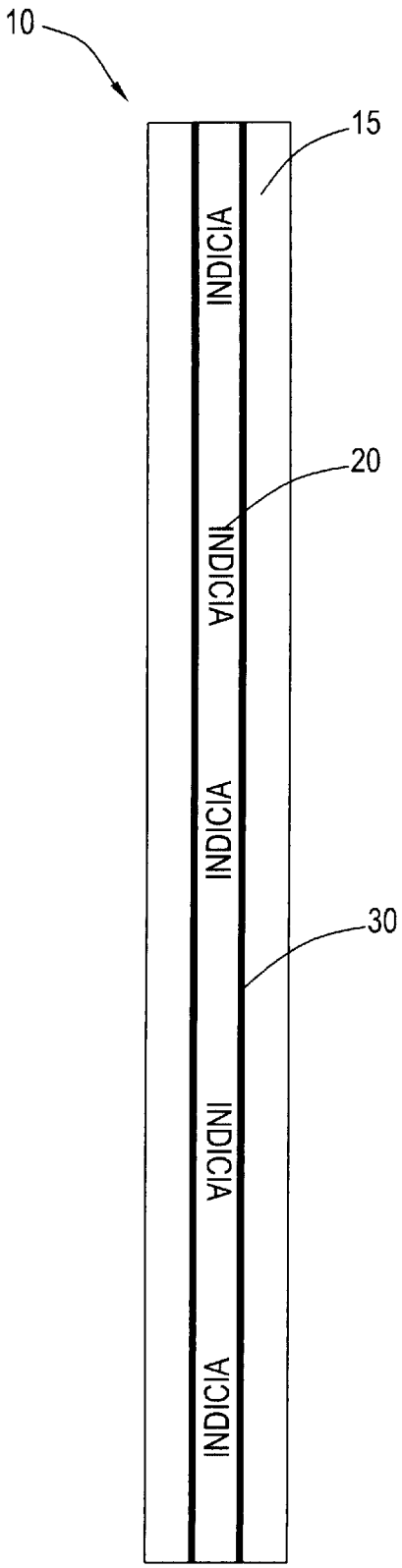
FIG. 1 is a plan view of one side of a shoulder strap of the present invention.

Referring to the drawings and, in particular, FIG. 1, there is provided a brassiere strap generally represented by reference numeral 10. Preferably, brassiere strap 10 is a brassiere shoulder strap. Brassiere strap 10 has a first surface 15 and a second surface (not shown) opposite the first surface. First surface 15 is the surface that will be positioned adjacent the wearer, while the second surface will face away from the wearer and thus be visible to an observer. Accordingly, the second surface can be made of any material.

Brassiere strap 10 is constructed or made of a rigid fabric. Such rigid fabrics include, but are not limited to, nylon, polyester, or a combination of nylon and polyester. Preferably, the rigid fabric is 100 percent nylon.

Preferably, brassiere strap 10 has a relatively uniform width. As used in the present invention, width means the dimension perpendicular to the axial extent of the brassiere strap. However, brassiere strap 10 can be made so that it has two or more widths. For example, the centermost portion of brassiere strap 10 may have a width that is somewhat larger than portions toward the ends of the brassiere strap.

In the preferred embodiments, brassiere strap 10 has a range of widths from about ⅝ inches to about ¾ inches. However, the width of brassiere strap 10 may be narrower or wider depending upon the style of the brassiere. Preferably, brassiere strap 10 has two different width sizes, namely about ⅝ inches and about ¾ inches.

As shown in the preferred embodiment of FIG. 1, brassiere strap 10 has an indicia 20 printed thereon. In a preferred embodiment, indicia 20 is text, such as, for example, the name of the brassiere maker. In an alternative embodiment, indicia 20 can instead be a design or logo, or a combination of text and a design or logo. Indicia 20 is printed onto first surface 15 of brassiere strap 10 by conventional printing methods using conventional print materials, such as, for example, non-washable ink.

Figure 2:
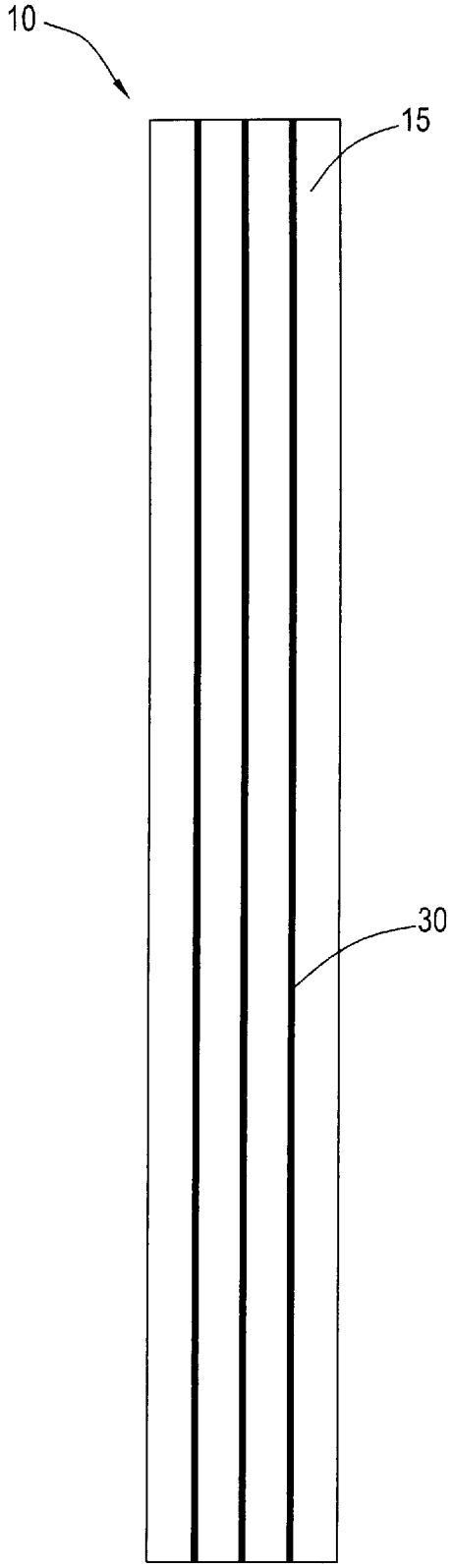
FIG. 2 is a plan view of one side of an alternative embodiment of the shoulder strap of the present invention.

As shown in the embodiments of FIG. 1 that has indicia 20, and FIG. 2 that is absent indicia, first surface 15 of brassiere strap 10 has at least two rows 30 of a silicone thereon. The silicone is preferably a silicone gel. The silicone gel is preferably extruded onto brassiere strap 10 in a fine bead. In a more preferred embodiment, the fine beads form a continuous line or row 30, as shown in FIGS. 1 and 2. However, the fine beads may form a row 30 in which adjacent beads have a slight space therebetween. Preferably, rows 30 are in a straight axial or longitudinal line. In an alternative embodiment, rows 30 may be applied in a wave or jagged line pattern, but in the axial or longitudinal direction.

The distance between adjacent rows 30 is about 1/16 inches to 1/8 inches. Preferably, the distance between the adjacent rows 30 is about 3/32 inches. The size of each bead is about 0.002 millimeters to 0.004 millimeters. Preferably, the size of each bead is about 0.003 millimeters in diameter.

In one preferred embodiment, brassiere strap 10 has a width of about 5/8 inch. In this embodiment, brassiere strap 10 has two rows 30. In another preferred embodiment in which brassiere strap 10 has a width about 3/4 inches, brassiere strap 10 has three rows 30. The number of rows 30 may vary depending upon the width of brassiere strap 10. Thus, should brassiere strap 10 be wider than 3/4 inches, there may be four or more rows 30. However, in all embodiments, it is believed that at least two rows 30 are needed.

First surface 15 of brassiere strap 10 is the surface that contacts a wearer's shoulder. The silicone forms a slight grip with the wearer's shoulder. This grip or adhesion is strong enough to prevent brassiere strap 10 from sliding off the wearer's shoulder, yet does not irritate the skin of the shoulder of the wearer.

In another alternative embodiment, the rigid fabric having rows 30 thereon may be formed into the side and/or back panels of a brassiere.

Buckling or curling of brassiere strap 10 may occur due to excessive wash and wear because the rigid fabric used to make brassiere strap 10 shrinks at a different rate than the silicone applied to the brassiere strap. An aspect of the present invention is a way to avoid this curling. To do so, the rigid fabric used to make brassiere strap 10 is pre-shrunk prior to the application of rows 30, and thus the silicone, on first surface 15. Indicia 20 is applied after the rigid fabric is pre-shrunk. Since brassiere strap 10 has been pre-shrunk, it has been found that the contraction of silicone rows 30 will not cause brassiere strap 10 to curl. Therefore, the present invention provides a flattened or non-curling brassiere strap 10 even though there is a use of silicone non-slip gel thereon.

Brassiere strap 10 has first surface 15 with rows 30 and perhaps indicia 20 thereon. Simultaneously, the second surface, opposite first surface 15, can have any material thereon. Such materials can have a satiny feel or include a decorative lace.

The present invention having been thus described with particular reference to the preferred forms thereof, it will be obvious that various changes and modifications may be made therein without departing from the spirit and scope of the present invention as defined in the appended claims.

What is claimed is:

1. A non-curling shoulder strap for a brassiere, comprising:

a body made of a preshrunk rigid fabric, having a first surface; and two or more rows of a silicone, each of said two or more rows in a line on said first surface, wherein said first surface is adapted to be positioned on a shoulder of a wearer to prevent slippage of the shoulder strap.

2. The non-curling shoulder strap of claim 1, wherein said preshrunk rigid fabric is a material selected from the group consisting of nylon, polyester, and a combination thereof.

3. The non-curling shoulder strap of claim 1, wherein said preshrunk rigid fabric has a width about 5/8 inches.

4. The non-curling shoulder strap of claim 3, wherein said two or more rows are two rows.

5. The non-curling shoulder strap of claim 4, wherein said first surface of said body has an indicia thereon.

6. The non-curling shoulder strap of claim 5, wherein said indicia is selected from a group consisting of text, design, and a combination thereof.

7. The non-curling shoulder strap of claim 1, wherein said rigid fabric has a width about 3/4 inches.

8. The non-curling shoulder strap of claim 7, wherein said two or more rows are three rows.

9. The non-curling shoulder strap of claim 8, wherein said first surface of said body has an indicia thereon.

10. The non-curling shoulder strap of claim 9, wherein said indicia is selected from a group consisting of text, design, and a combination thereof.

11. The non-curling shoulder strap of claim 1, wherein said line is a straight line.

12. The non-curling shoulder strap of claim 1, wherein said line is a wave or jagged line.

13. A method of making a brassiere strap comprising:

forming the brassiere of a rigid fabric strap having a first surface;

pre-shrinking the brassiere strap; and applying of a silicone onto the first surface of the brassiere strap, said pre-shrinking voiding curling of the rigid fabric caused by the silicone as a result of subsequent washing of the brassiere strap.

14. A method of making a brassiere strap comprising:

forming the brassiere strap having a first surface;

pre-shrinking the brassiere strap;

applying two or more rows of a silicone onto the first surface of the brassiere strap; and applying an indicia onto the first surface of the brassiere strap after forming the brassiere strap and prior to pre-shrinking the brassiere strap.

* * * * *